US007025535B2

(12) United States Patent
Chiesa et al.

(10) Patent No.: US 7,025,535 B2
(45) Date of Patent: Apr. 11, 2006

(54) SEAFLOOR/SURFACE CONNECTING INSTALLATION FOR A SUBMARINE PIPELINE WHICH IS CONNECTED TO A RISER BY MEANS OF AT LEAST ONE ELBOW PIPE ELEMENT THAT IS SUPPORTED BY A BASE

(75) Inventors: Giovanni Chiesa, San Donato Milanese (IT); Floriano Casola, Gazzada Schianno (IT); François-Régis Pionetti, La Baleine (FR)

(73) Assignee: Saipem S.A., Montigny le Bretonneux (FR)

( * ) Notice: Subject to any disclaimer, the term of this patent is extended or adjusted under 35 U.S.C. 154(b) by 0 days.

(21) Appl. No.: 10/513,374

(22) PCT Filed: May 5, 2003

(86) PCT No.: PCT/FR03/01384

§ 371 (c)(1),
(2), (4) Date: Jul. 1, 2005

(87) PCT Pub. No.: WO03/095788

PCT Pub. Date: Nov. 20, 2003

(65) Prior Publication Data

US 2005/0271476 A1 Dec. 8, 2005

(30) Foreign Application Priority Data

May 7, 2002 (FR) ..... 02 05968

(51) Int. Cl.
*F16L 1/26* (2006.01)
*E21B 17/01* (2006.01)

(52) U.S. Cl. ..... 405/169; 405/171; 405/172; 166/359; 166/350; 166/367

(58) Field of Classification Search ..... 405/169–172, 405/224.2, 224.3; 166/350, 359, 367
See application file for complete search history.

(56) References Cited

U.S. PATENT DOCUMENTS 4,024,724 A 5/1977 Horton (Continued)

FOREIGN PATENT DOCUMENTS

FR 2821143 8/2002

(Continued)

*Primary Examiner*—Frederick L. Lagman
(74) *Attorney, Agent, or Firm*—Cohen, Pontani, Lieberman & Pavane

(57) ABSTRACT

A bottom-to-surface connection installation for an undersea pipe. The installation comprises a vertical riser having its bottom end connected to an undersea pipe on the sea bed, and having a float at its top end, and a pipe connecting a floating support at the top end of the vertical riser. The connection between the riser bottom end and the undersea pipe is via an anchor system having a base on the sea bed. The base holds and guides junction elements between the bottom end of the riser and the end of the lower end of the undersea pipe. The junction elements comprise a rigid pipe element presenting an angled bend and a pipe coupling element which are fixed to a moving support of the base. The junction elements are fixed to the moving support and are free to move only in translation in a single longitudinal direction.

13 Claims, 10 Drawing Sheets

U.S. PATENT DOCUMENTS 4,199,275 A 4/1980 Tuson
4,462,717 A 7/1984 Falcimaigne
4,615,646 A 10/1986 Langner
4,906,137 A * 3/1990 Maloberti et al. ..... 405/169
6,854,930 B1 * 2/2005 Pionetti ..... 405/172

FOREIGN PATENT DOCUMENTS

WO WO 00/49267 8/2000

* cited by examiner

SEAFLOOR/SURFACE CONNECTING INSTALLATION FOR A SUBMARINE PIPELINE WHICH IS CONNECTED TO A RISER BY MEANS OF AT LEAST ONE ELBOW PIPE ELEMENT THAT IS SUPPORTED BY A BASE

PRIORITY CLAIM

This is a U.S. national stage of application No. PCT/FR03/01384, filed on May 5, 2003. Priority is claimed on the following application: Country: France, Application No.: 02/05968, Filed: May 7, 2002.

FIELD OF THE INVENTION

The present invention provides a bottom-to-surface connection installation for at least one undersea pipe installed at great depth, the installation being of the hybrid tower type.

BACKGROUND OF THE INVENTION

The technical field of the invention is that of making and installing production risers for extracting oil, gas, or other soluble or fusible material or a suspension of mineral material from the sea bed via an undersea well head for the purpose of developing production fields installed at sea, off-shore. The main and immediate application of the invention lies in the field of producing oil.

A floating support generally comprises anchor means for remaining in position in spite of the effects of currents, winds, and swell. It generally also includes means for storing and processing oil and means for off-loading oil to shuttle tankers which call at regular intervals to take away the production. Such floating supports are known by the acronym FPSO which stands for "floating production storage off-loading". The acronym is used throughout the description below.

Because of the large number of lines that exist in an installation of this type, hybrid tower type bottom-to-surface connections are implemented in which substantially vertical rigid pipes referred to as vertical "risers" are connected to the undersea pipe resting on the sea bed and rise up a tower to a depth that is close to the surface, from which depth flexible hoses provide a connection between the top of the tower and the floating support (FPSO). The tower is then provided with buoyancy means enabling it to remain in the vertical position, and the risers are connected at the foot of the tower to the undersea pipe by flexible sleeves which absorb the angular movements of the tower. The assembly is commonly referred to as a "hybrid" tower since it makes use of two technologies, firstly a vertical portion known as the "tower" in which the riser is constituted by rigid pipes, and secondly the top portion of the riser which is constituted by flexible hoses in catenary configurations providing the connection with the floating support (FPSO).

French patent No. FR 2 507 672 published on Dec. 17, 1982 and entitled "Rising column for great depths of water" describes one such hybrid tower.

OBJECT AND SUMMARY OF THE INVENTION

The present invention relates more particularly to the known field of connections of the type comprising a vertical hybrid tower anchored to the sea bed and comprising a float situated at the top of a vertical riser, and which is connected to a floating support (FPSO) on the surface by means of a pipe, in particular a flexible hosepipe which, under its own weight, takes up the shape of a catenary suspended from the top of the riser.

The advantage of such a hybrid tower lies in the ability of the floating support to depart from its nominal position while inducing minimal stresses in the tower and in the hose portions occupying the shape of a suspended catenary, both at the surface and under water.

International patent WO 00/49267 in the name of the present Applicant describes a tower whose float is located at a depth greater than half the depth of the water, with the catenary connection to the surface ship being implemented by means of very thick, rigid pipes. At its base, the tower as described therein requires flexible connection sleeves enabling the bottom ends of the vertical risers of said tower to be connected to the undersea pipe resting on the sea bed in such a manner as to be capable of absorbing the movements that result from expansions due to the temperature of the fluid being transported.

More particularly, in WO 00/49267, the anchor system comprises a vertical tendon constituted either by a cable or by a metal bar or indeed by a pipe held at its top end by a float. The bottom end of the tendon is fixed to a base resting on the sea bed. Said tendon has guide means distributed along its entire length and said vertical risers pass therethrough. Said base may merely be placed on the sea bottom remaining in place under its own weight, or it may be anchored by means of piles or any other device suitable for holding it in place. In WO 00/49267, the bottom end of the vertical riser is suitable for being connected to the end of an angled sleeve that moves between a high position and a low position relative to said base, the sleeve being suspended from the base and being associated with return means for returning it into its high position in the absence of the riser. This mobility of the angled sleeve makes it possible to absorb variations in the length of the riser due to the effects of temperature and pressure. At the head of the vertical riser, and abutment device secured thereto presses against the support guide installed at the head of the float, thus keeping the entire riser in suspension.

The connection with the undersea pipe resting on the sea bed is generally made by means of a length of pipe in the form of a pigtail or of an S-shape, with the S-shape then lying either in a vertical plane or a horizontal plane, the connection with the undersea pipe generally being made via an automatic connector.

In addition, since the crude oil travels over distances that are very long, distance of several kilometers, it is desirable to provide a high degree of insulation firstly in order to minimize any increase in viscosity which would reduce the hourly production rate of the well, and secondly to prevent the flow becoming blocked by paraffin being deposited or by hydrates forming in the event of the temperature falling to around 30° C. to 40° C. These phenomena are particularly critical in West Africa since the water temperature at the sea bed is about 4° C. and the crude oil is of the paraffinic type.

Numerous thermal insulation systems are known enabling the required level of performance to be achieved and capable of withstanding the pressure at the bottom of the sea which is about 150 bars at a depth of 1500 meters (m). Amongst others, specific mention can be made of concepts of the "pipe-in-pipe" type comprising a pipe conveying the hot fluid installed inside an outer protective pipe, with the space between the two pipes either being merely filled with optionally confined lagging in a vacuum, or else being merely evacuated. Numerous other materials have been developed for providing high performance insulation, some of them being capable of withstanding pressure, said materials merely surrounding the hot pipe and generally being confined within a flexible or rigid outer casing in pressure equilibrium and having the main function of ensuring that the shape of the pipe remains substantially constant over time.

To varying degrees, all of those devices conveying a hot fluid within an isolated pipe present phenomena associated with differential expansion. The inner pipe is generally made of steel and is at a temperature that it is desired to keep as high as possible, for example 60° C. or 80° C., while the outer casing, usually also made of steel, is at the same temperature as the sea water, i.e. around 4° C. The forces generated on the connection elements between the inner pipe and the outer casing are considerable and can reach several tens or even several hundreds of (metric) tones, and the resulting overall lengthening is of the order of 1 m to 2 m for insulated pipes having a length of 1000 m to 1200 m.

The problem posed by the present invention is that of being able to make and install such bottom-to-surface connections for undersea pipes at great depths, e.g. at depths of more than 1000 m, the connections being of the type comprising a vertical tower and the fluid being transported needing to be maintained above some minimum temperature until it reaches the surface, while minimizing the components that are subjected to heat losses, and while avoiding the drawbacks created by thermal expansion or differential thermal expansion of the various components of said tower so as to withstand the extreme stresses and fatigue phenomena that accumulate over the lifetime of the installation, which lifetime commonly exceeds 20 years.

Another problem of the present invention is to provide a bottom-to-surface connection installation of the hybrid tower type in which the anchoring system is very strong and low in cost, and in which the method of putting the various component elements into place is simple and likewise of low cost.

Another problem on which the invention is based is that of providing an installation which makes it possible to take action on the inside of the undersea pipe resting on the sea bed using a "coiled tubing" type method, acting from the surface and from the top end of the vertical riser.

A solution to the problems posed is thus a bottom-to-surface connection installation for an undersea pipe resting on the sea bed, in particular at great depth, the installation comprising:

a) at least one vertical riser having its bottom end connected to at least one undersea pipe resting on the sea bed, and having at least one float at its top end; and b) at least one connection pipe, preferably a flexible hose, providing the connection between a floating support (FPSO) and the top end of said vertical riser; and c) the connection between the bottom end of said vertical riser and a said undersea pipe resting on the sea bed is made via an anchor system comprising a base placed on the sea bed.

According to the invention, the installation is characterized in that:

said base serves to hold and guide junction elements between the bottom end of said vertical riser and the end of the rectilinear horizontal end portion of said pipe resting on the sea bed, and said junction elements comprise:

a rigid pipe element presenting an angled bend; and a pipe coupling element, preferably a single coupling element, and more preferably a single automatic connector;

said junction elements being held and guided in such a manner that they are free to move only in translation in a single longitudinal direction YY' corresponding substantially to the axial direction of said horizontal rectilinear end portion of said undersea pipe resting on the sea bed.

It will be understood that said junction elements which can move with only one degree of freedom in linear translation are thus capable of absorbing any expansion and contraction movements in said movements of the pipe resting on the sea bed, as explained below.

Said junction elements are thus prevented from performing any other movement in translation or in rotation, and in particular they cannot move laterally or vertically. Thus, in the present invention, the point at a substantially fixed altitude is located at the bottom of the tower at the flexible joint, thus making it possible to omit the angled connection sleeves of the prior art, since the vertical movements of the riser are absorbed by the float which is free to move vertically at the top of said riser.

The term "angled bend" is used to mean two short rectilinear sections disposed at 90° to each other which are separated and interconnected by a curved section presenting a radius of curvature which is preferably a large radius of curvature, in particular a radius of curvature greater than 5 m, and more particularly lying in the range 5 m to 10 m, said angled pipe portion presenting an axial plane containing the axes of said two rectilinear pipe sections that are disposed at 90° to each other. In general, the bend is in the form of a circular arc. This pipe element presenting a bend can be made using a rigid pipe element, in particular an element having a length of 7 m to 15 m.

It will be understood that said angled pipe portion providing the junction between said vertical riser and said pipe resting horizontally on the sea bed is disposed in such a manner that its said axial plane lies in a vertical position.

The term "vertical riser" is used herein to refer to the ideal position of the riser when it is at rest, it being understood that the axis of the riser may be subjected to angular movements relative to the vertical and may move within a cone of angle $\alpha$ whose apex corresponds to the point where the bottom end of the riser is fixed to said base.

The term "vertical axial plane" as applied to the angled pipe element means that this axial plane is in a position that is perpendicular relative to the plane of the sea bed on which said base rests, which plane is ideally a horizontal plane, and said axial plane contains the axis of the rectilinear end portion of the pipe resting on the sea bed.

Said coupling elements are constituted by a male or female first portion co-operating with a second portion that is respectively female or male.

Said coupling elements, in particular automatic connector type elements, are known to the person skilled in the art and include locking means between a male portion and a complementary female portion, the locking means being designed to be operated very simply at the sea bed with the help of a remotely operated vehicle (ROV), i.e. a robot that is controlled from the surface, without requiring any direct manual action by a diver.

Said connection pipe between the floating support (FPSO) and the top end of the vertical riser may be:

a hose that is flexible or of small rigidity if the head float is close to the surface; or a rigid pipe if the head float is at great depth.

In an advantageous embodiment, said base comprises:

a platform resting on the sea bed; and a moving support to which said junction elements are fixed; and said moving support being suitable for moving, preferably in controlled manner, on said platform in a said translation in a said longitudinal direction YY' substantially corresponding to the axial direction of the horizontal end portion of said undersea pipe resting on the sea bed.

The term "controlled displacement" is used to mean displacement of amplitude that is limited by mechanical abutments secured to the platform.

The platform comprises a structure constituting guide elements such as a barrier or a slideway preventing any other displacement of the moving support in a lateral direction XX' or upwards, i.e. in a vertical direction ZZ'.

The installation of the present invention is advantageous since said junction elements occupy a relatively static configuration relative to said base, and more particularly relative to said moving support, said junction elements being held rigidly on said moving support. The bottom portion of the tower is thus properly stabilized and does not have to withstand any force, particularly via the coupling between the vertical riser and the pipe resting on the sea bed, since the longitudinal movements in translation of the moving support create flexibility at the end of the undersea pipe resting on the sea bed, said flexibility being capable of absorbing by deformation any elongation or contraction of the undersea pipe under the effect of temperature and pressure, thus avoiding creating any major thrust forces within the undersea pipe, which forces could otherwise reach 100 tonnes or 200 tonnes or even more, and would otherwise be transmitted to the foundation structure of the riser tower.

In a preferred embodiment, the bottom end portion of said vertical riser has a preferably reinforced flexible joint enabling the portion of said vertical riser situated above said flexible joint to move angularly $\alpha$, and said junction elements comprise said flexible joint or a portion of vertical risers situated beneath said flexible joint.

A flexible joint can accommodate large variation in the angle $\alpha$ between the axis of the riser and its ideal vertical position at rest without generating significant stresses in the pipe portions situated on either side of said flexible joint: such flexible joints are known to the person skilled in the art and can be constituted by a spherical ball with a sealing gasket, or by a laminated ball built up as a sandwich of elastomer sheets and of metal sheets bonded together and capable of absorbing large angular movements by deforming the elastomer sheets while maintaining total leaktightness because of the absence of any friction joint. Said angle $\alpha$ generally lies in the range 10° to 15°.

In any event, said flexible joint is hollow so as to pass the fluid, and its inside diameter is preferably substantially the same as the inside diameter of the adjacent pipe connected thereto, and in particular the same as the diameter of the vertical riser.

The term "reinforced flexible joint" is used herein to mean a joint capable of transferring to the moving support the vertical forces created by the tension generated by the float under the surface, and the horizontal forces created by the swell, and the currents acting on the vertical portion of the riser, on the float, and on the flexible hose going to the floating support, and also by any displacements of said floating support.

When said junction elements include said flexible joint, said flexible joint is thus held in a fixed position relative to said moving support. Said flexible joint then corresponds to a terminal element for the junction elements providing the junction with said vertical riser.

Because of the presence of said flexible joint, and of the flexible connection to the floating support situated at the head of the vertical riser, horizontal displacement of the base of the vertical riser which is at a point of substantially fixed altitude, gives rise to no significant force in the hinged assembly constituted by said moving support, said flexible joint, said riser, and said connection to the surface support under the effect of displacement of said moving support within said base platform, which displacement generally does not exceed 5 m.

Another advantage of the present invention is also a considerable reduction in overall cost that results from omitting the sleeves used in the prior art for connecting the vertical riser with the undersea pipe resting on the sea bed.

The installation of the invention makes it possible to eliminate all those drawbacks of the prior art and to provide at reduced costs a riser tower that incorporates the highest performance insulation technologies.

In a first variant embodiment of the invention, the installation comprises:

a preferably male first portion of a said coupling element is secured to said flexible joint and located immediately beneath it; and said undersea pipe resting on the sea bed is terminated by a said rigid pipe element having an angled bend presenting at its end a preferably female second portion of a said coupling element suitable for co-operating with said first portion to form said coupling element.

In another variant embodiment of the installation of the invention:

said rigid pipe element presenting an angled bend is fixed directly to the underface of said flexible joint and at its other end has a preferably female first portion of a said coupling element; and said preferably female first portion of the coupling element co-operates with a preferably male second portion of the coupling element at the end of a horizontal end portion of an undersea pipe on the sea bed so as to form a said coupling element.

Thus, said pipe element having an angled bend may be:

either pre-installed at the end of the undersea pipe resting on the sea bed so as to constitute the end pipe element thereof;

or else pre-installed at the bottom end of said vertical riser, and more particularly underneath said flexible joint.

In both cases, said rigid angled pipe element presents at its free end a male or female first portion of a coupling element, and the complementary, female or male respectively, second portion of said coupling element is situated either at the end of the rectilinear end pipe element of said pipe resting on the sea bed, or else at the end of said vertical riser, and more particularly immediately beneath said flexible joint.

For reasons of ease of installation on the sea bed, and as explained below, it is preferable to pre-install said rigid angled pipe element at the end of the pipe resting on the sea bed and to cause the male first portion of said coupling element at the end of said angled bend element to co-operate with a complementary female second portion of the coupling element situated on the underside of said flexible joint. Naturally, it is possible to envisage a short portion of rectilinear riser providing the junction between said flexible joint and said second portion of the coupling element.

In an advantageous embodiment, said moving support includes a central cavity that is upwardly-open via a top orifice suitable for receiving said rigid pipe element presenting an angled bend within said moving support when said element is lowered from the surface.

This embodiment as described above makes it easier to put the installation into place and to couple the vertical riser and the undersea pipe resting on the sea bed while the installation is being put into place.

More particularly, said top orifice co-operates with blocking elements, preferably a wedge system, enabling said reinforced flexible joint to be blocked, which joint is thus held rigidly and securely to said moving support, and the horizontal end portion of said pipe resting on the sea bed is held securely to the bottom of said moving support, preferably by means of a collar system.

Thus, all of said junction elements are held stationary relative to said moving support and any expansion or contraction of the pipe that may arise in said axial longitudinal direction of the horizontal end portion of said pipe resting on the sea bed causes said moving support to be displaced together with the junction elements in translation in the same longitudinal direction.

The following characteristics taken separately or in combination are also advantageous:

said top orifice presents a funnel-shaped peripheral inside wall with a large base on top, and said wedges enabling said reinforced flexible joint to be blocked are constituted by truncated-cone wedges;

said platform includes guide and holding elements for engaging said moving support in such a manner that said moving support can move on said platform only by sliding in translation in said longitudinal direction YY', preferably with the help of skids;

said moving support is held laterally between two lateral guide barriers of said platform, and said lateral guide barriers co-operate with moving blocking elements which, in a disengaged, retracted position allow said moving support to be lowered from the surface into a position between said two lateral barriers from above said platform, and in an advanced, blocking position co-operate with the outside shape of said moving support so as to control vertical upward displacement ZZ' thereof; and said base comprises a platform resting on the sea bed, which platform co-operates with stabilizing elements comprising deadweights placed on top of said platform, or suction anchors passing through said platform in order to be engaged in the sea bed, and/or spade-type projecting elements placed on the underface of said platform and engaged in the sea bed to prevent any sliding of said platform over the sea bed.

Since the junctions between the various components of the assembly comprising the float, the flexible hose, and the vertical riser are all situated not far from the surface, they are subjected to the combined effects of swell and current. In addition, since the surface support is subjected not only to swell and currents, but also the effects of wind, movement of said assembly generates considerable forces in the various mechanical components at the singular point as constituted by the junction between the riser and the flexible hose. The float exerts upwardly-directed vertical traction that can lie in the range several tens of tones to several hundreds of tones or even more than 1000 tones, depending on the depth of the water which may be 1500 m or even 3000 m, and depending on the inside diameter of the pipe which may lie in the range 6 inches (") to 14", or even 16". Thus, the forces to be transmitted are considerable and the movements of the assembly are driven, amongst other things, at the rate of the swell, i.e. with a period that typically varies in rough weather in the range 8 seconds (s) to 20 s. The fatigue cycles that are accumulated over the lifetime of the oil field thus exceeds several tens of millions of cycles. That is why an installation of the present invention advantageously includes at least one float.

Another problem of the present invention is to make it easy to take action on the inside of said riser from the surface, in particular in order to inspect or clean said vertical riser by inserting a rigid tube from the top end of the float, the tube passing through said connection device between the float and the vertical riser.

Bottom-to-surface connections convey a fluid with multiple phases, i.e. a fluid made up of crude oil, water, and gas. Unfortunately, as the fluid rises, local pressure decreases so gas bubbles increase in volume, thereby leading to instability phenomena in the stream of fluid that can lead to high levels of jolting. In the event of production being stopped, gas accumulates in the high portions and the oil and water mixture is trapped in the low portions, specifically in the bottom portion of the catenary-shaped hose, and also in the bottom portion of the substantially vertical section of the riser, or indeed beyond the bend situated at the foot of the vertical riser, in the horizontal portion of the undersea pipe resting on the sea bed.

When temperature drops below a value lying in the range 30° C. to 40° C., the multiphase mixture made up of crude oil, water, and gas tends to create plugs of two different types that run the risk of blocking production. A first type of plug is due to hydrates forming from the gas phase in the presence of water, and another type of plug is due to the paraffin that is contained in variable quantities in the crude oil freezing, with paraffin content being particularly high in certain oil fields such as those in West Africa.

A method of taking action on the insides of such pipes is known as the "coiled tubing" method and consists in pushing a small diameter rigid tube, along the pipe, the diameter of the tube generally lying in the range 20 mm to 50 mm. Said rigid tube is stored in rolled form, merely by bending on a drum, and it is then untwisted while it is being unwound. Said tube may be several thousands of meters long in a single length. The end of the tube situated on the hub of the storage drum is connected via a rotary joint to a pumping device capable of injecting a fluid at high pressure and high temperature. Thus, by pushing the small diameter tube along the pipe, while maintaining pumping and back pressure, the pipe is cleaned by injecting a hot substance capable of dissolving plugs. This method of taking action is commonly used on vertical wells or on pipes that have become blocked by paraffin or hydrates forming, which phenomena are commonplace and to be feared in all installations for producing crude oil. The "coiled tubing" method is also referred to herein as continuous tube cleaning (CPC).

The installation of the invention includes a connection device between said float and the top end of said riser, the device comprising:

a second flexible hose whose ends are received respectively in said float and the top end of the riser;

the connection between said second flexible hose and the top end of said riser taking place via a device that is swan-neck-shaped, which swan-neck-shaped device provides the connection between said riser and a said pipe connected to the floating support, preferably a said flexible hose; and said second flexible hose being preferably extended through said float by a rigid tubular pipe passing right through the float so that it is possible to take action inside said vertical riser from the top portion of the float via said rigid tubular pipe, and then through said connection device constituted by said second flexible hose and through said swan-neck-shaped device, so as to gain access to the inside of said riser and, by injecting liquid and/or scraping clean the inside wall of said riser, and then of said undersea pipe resting on the sea bed.

The installation of the present invention is still more particularly advantageous when:

two of said undersea pipes resting on the sea bed are assembled together as a bundle within a common flexible protective casing for confining an insulating material, preferably a phase-change material of the paraffin type, an insulating gel compound, or a combination of both, said material surrounding said pipe; and the top portion of said vertical riser above said flexible joint comprises a system of insulated pipes constituted by a set of two coaxial pipes comprising an inner pipe and an outer pipe together with an insulating fluid or material, preferably a phase-change material of the paraffin type or an insulating gel compound or a combination of both placed preferably between said two pipes, or indeed by providing a vacuum between said two pipes.

Another advantage of the installation of the invention is that all of its elements can be prefabricated on land before being installed. They can thus be assembled for test purposes in order to verify that all of the elements co-operate properly, including the locking means; this makes the installation considerably simpler to assemble and reduces the time ships are in use while putting the installation into place. In the prior art, the undersea pipes were laid initially, and then after the risers had been installed, angled coupling sleeves were made on the basis of high precision measurements taken using ROVs. A sleeve prefabricated on land or on site can be several tens of meters long and then needs to be installed using the same ROV, which requires a considerable amount of operating time, and thus represents a cost that is very high because of the sophistication of the specialized ships used for installation purposes. The saving achieved by the device and method of the invention amounts to several days of installation ship time and also to omitting the automatic connectors that are otherwise essential at each of the ends of the prefabricated sleeve, which represents a considerable reduction in cost.

The objects of the present invention are thus also achieved by a method of putting an installation into place, which method comprises the following steps:

1. placing a said base on the sea bed; and
2. lowering to the sea bed, a said undersea pipe for resting on the sea bed, the pipe having at its end at least a portion of said junction elements including at their end a first portion of a coupling element; and
3. securing the rectilinear horizontal end portion of said pipe resting on the sea bed to said base; and
4. lowering said vertical riser including at its end at least the other portion of said junction elements, comprising at their bottom end at least a said second portion of a coupling element; and
5. coupling said first and second portions together to form said coupling element; and
6. blocking said junction elements on said base.

More particularly, in the method of the invention, in which said base comprises a said platform and at least one said moving support, the following steps are performed:

1. placing said platform on the sea bed, and placing said moving support on said platform, then actuating said latches to control and prevent upward displacement of said moving support relative to said platform while leaving said moving support free to move in controlled translation in said longitudinal direction YY'; and
2. lowering a said undersea pipe to the sea bed and putting it in place thereon, the pipe being fitted at its end with a least a portion of said junction elements including at their end at least a said first portion of a coupling element; and
3. securing the horizontal rectilinear end portion of said pipe resting on the sea bed on the bottom of said moving support; and
4. lowering a said vertical riser fitted at its bottom end with at least the other portion of said junction elements comprising at their end a said complementary second portion of a coupling element; and
5. moving said first and second portions of a coupling element towards each other and coupling them together; and
6. blocking said junction elements on said moving support.

In a variant embodiment of the method, the moving support is assembled at the surface within the platform, and then the assembly is lowered and put into place on the sea bed.

In order to implement a preferred version of the embodiment of the method of the invention, said junction elements are such that:

a) said undersea pipe resting on the sea bed is fitted at its end with a said rigid pipe element presenting an angled bend, said angled pipe element presenting at its top end a said first portion of a coupling element; and b) said vertical riser is fitted at its bottom end with a said flexible joint and with a said second portion of a coupling element at the underface of said flexible joint.

BRIEF DESCRIPTION OF THE DRAWINGS

Other characteristics and advantages of the present invention appear in the light of the following detailed description of embodiments given with reference to FIGS. 1 to 12.

DETAILED DESCRIPTION OF AN EMBODIMENT

Figure 1:
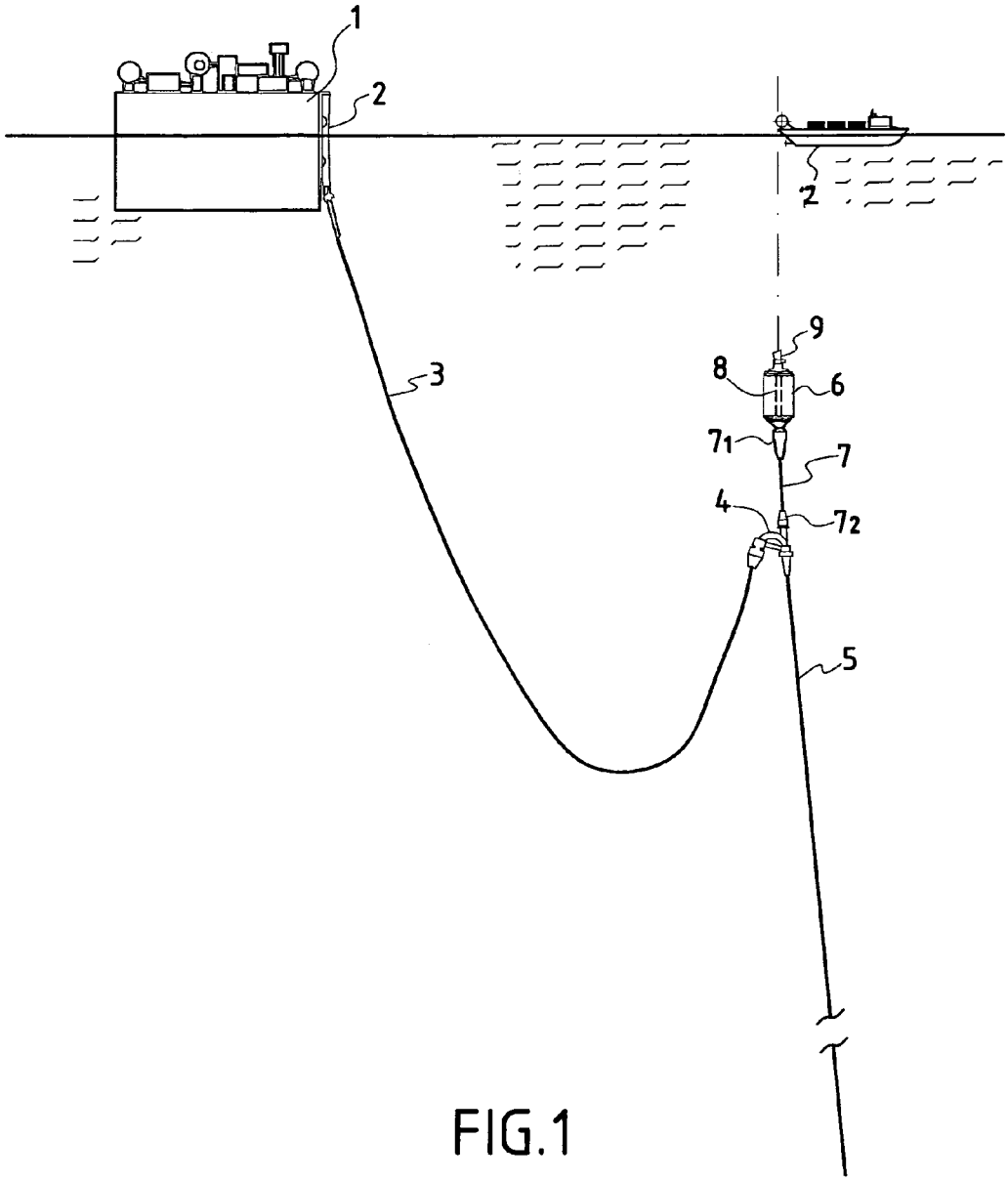
FIG. 1 is a side view of a top portion of a hybrid tower connected to an FPSO type floating support, with a ship 2 performing an intervention operation vertically above said tower.

In FIG. 1, the FPSO 1 is anchored over an oil field at a depth of 1500 m under water, by means of an anchor system (not shown), and it includes on its side a support system $\mathbf{2}_1$ for supporting flexible pipes 3 conveying oil effluent in a catenary configuration rising towards a swan-neck-shaped device $\mathbf{4}_1$, itself secured to the top end of a vertical riser 5. The assembly is kept under tension by said float 6 connected to the head of the vertical riser 5 via a flexible hose 7. Said float 6 has a pipe 8 passing through it in continuity with said hose 7 to lead to an orifice closed by a valve 9. An intervention ship 2 situated vertically above said float can undertake maintenance operations by means of coiled tubing passing through the float 6, whereby a rigid pipe (not shown) of small diameter (generally 50 mm) is pushed into the vertical portion of the pipe in order to clean the inside thereof as it advances. Since coiled tubing devices are known to the person skilled in the art in the field of intervening on an oil well, such devices are not described in greater detail herein.

In FIGS. 2 to 4 and 6 to 12, there can be seen the bottom portion of an installation of the invention in which the connection between the bottom end of said vertical riser 5 and said undersea pipe 10 lying on the sea bed is provided by means of an anchor system comprising a base 4 placed on the sea bed.

Said base 4 comprises:

a platform 15 resting on the sea bed; and a moving support 14 to which said junction elements 11–13 are fixed; and said moving support 14 being suitable for moving in controlled manner on said platform in displacement in translation along a longitudinal direction YY' corresponding to the axial direction of the horizontal end portion of said undersea pipe 10 resting on the sea bed.

The platform 15 comprises a structure constituting guide elements $\mathbf{16}_1$ forming a barrier or slideway to prevent any other displacement of the moving support in a lateral direction XX', or vertically, i.e. in a vertical direction ZZ'.

Said base 4 serves to hold the junction elements 11–13 rigidly and to guide them between the bottom end of said vertical riser 5 and the end of the rectilinear horizontal end portion of said pipe 10 resting on the sea bed, and said junction elements 11–13 comprise a pipe element presenting an angled bend 11 and a pipe coupling element 12, preferably a single coupling element, and more preferably an automatic single connector, said junction elements 11–13 being held and guided in such a manner that they are capable of moving only in translation in a single longitudinal direction YY' corresponding to the axial direction of said horizontal rectilinear end portion of said undersea pipe 10 resting on the sea bed.

Figure 2:
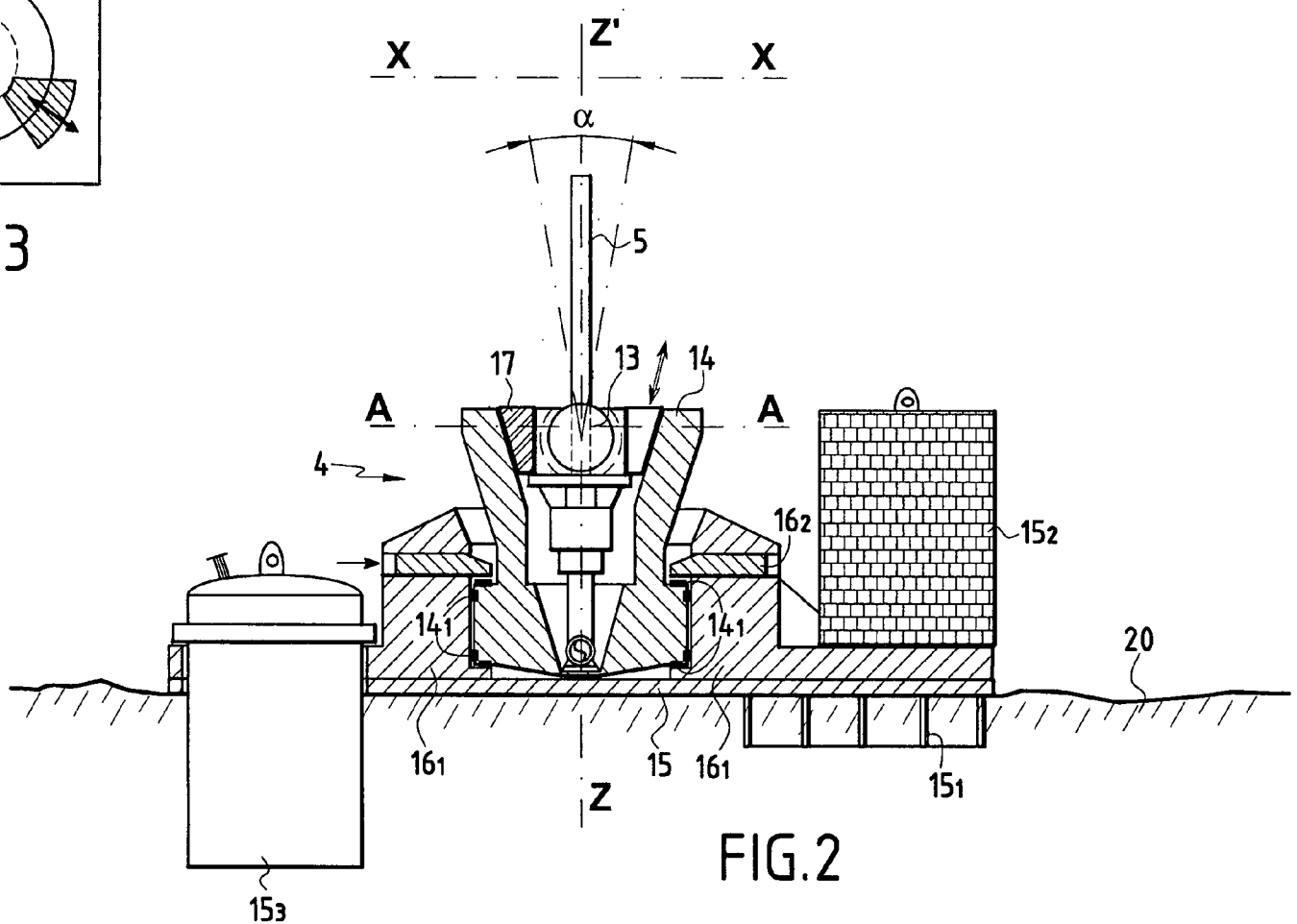
FIG. 2 is a section view of the bottom portion of the installation of the invention, after the vertical riser has been coupled to said undersea pipe resting on the sea bed.
Figure 9:
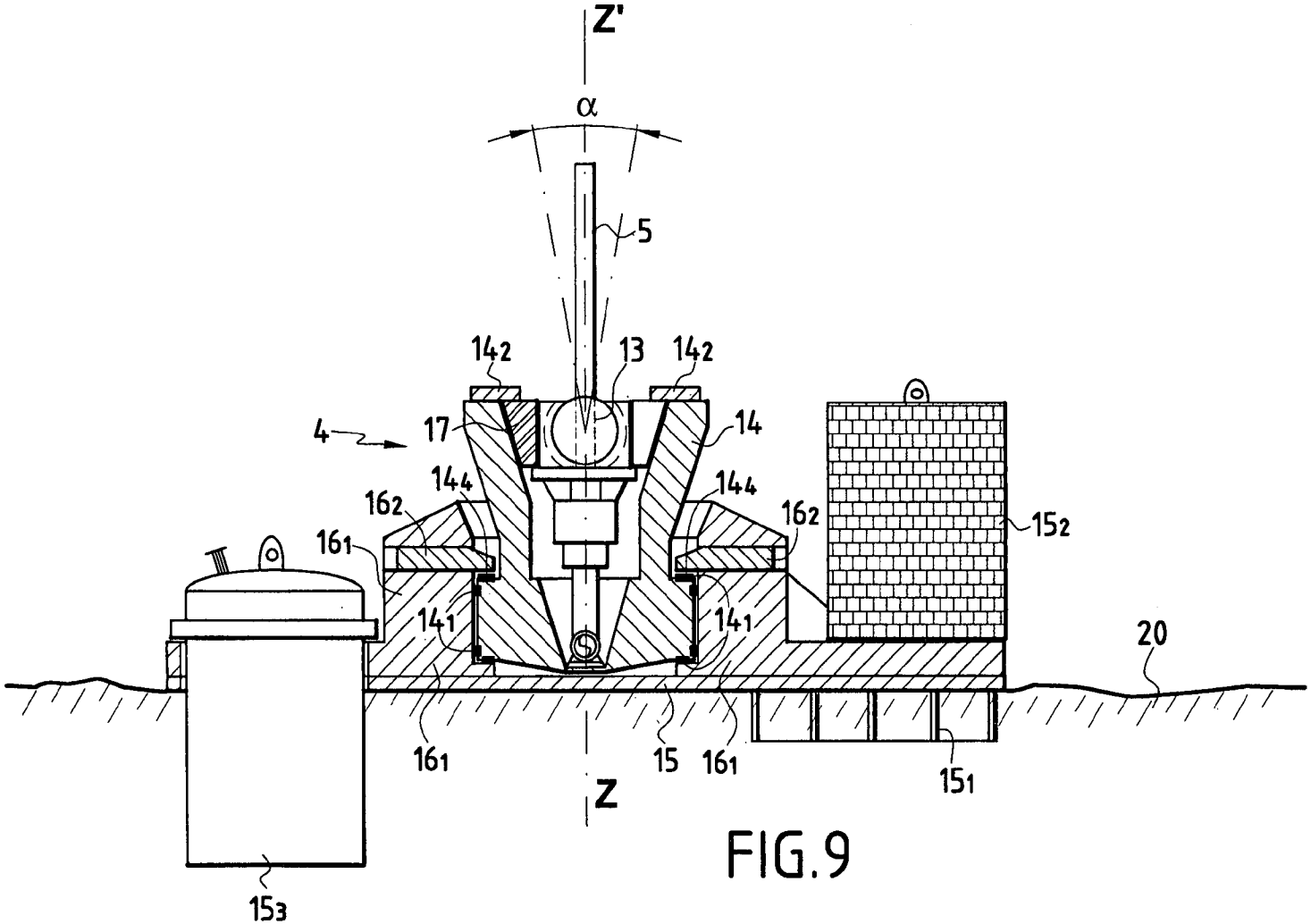
FIG. 9 is a section view of the bottom portion of the installation after the pipes have been coupled at the underface of the flexible joint.

FIGS. 2 and 9 are end-on section views of an installation of the invention after all of the junction elements and the pipes for coupling together have been put into place.

Figure 4:
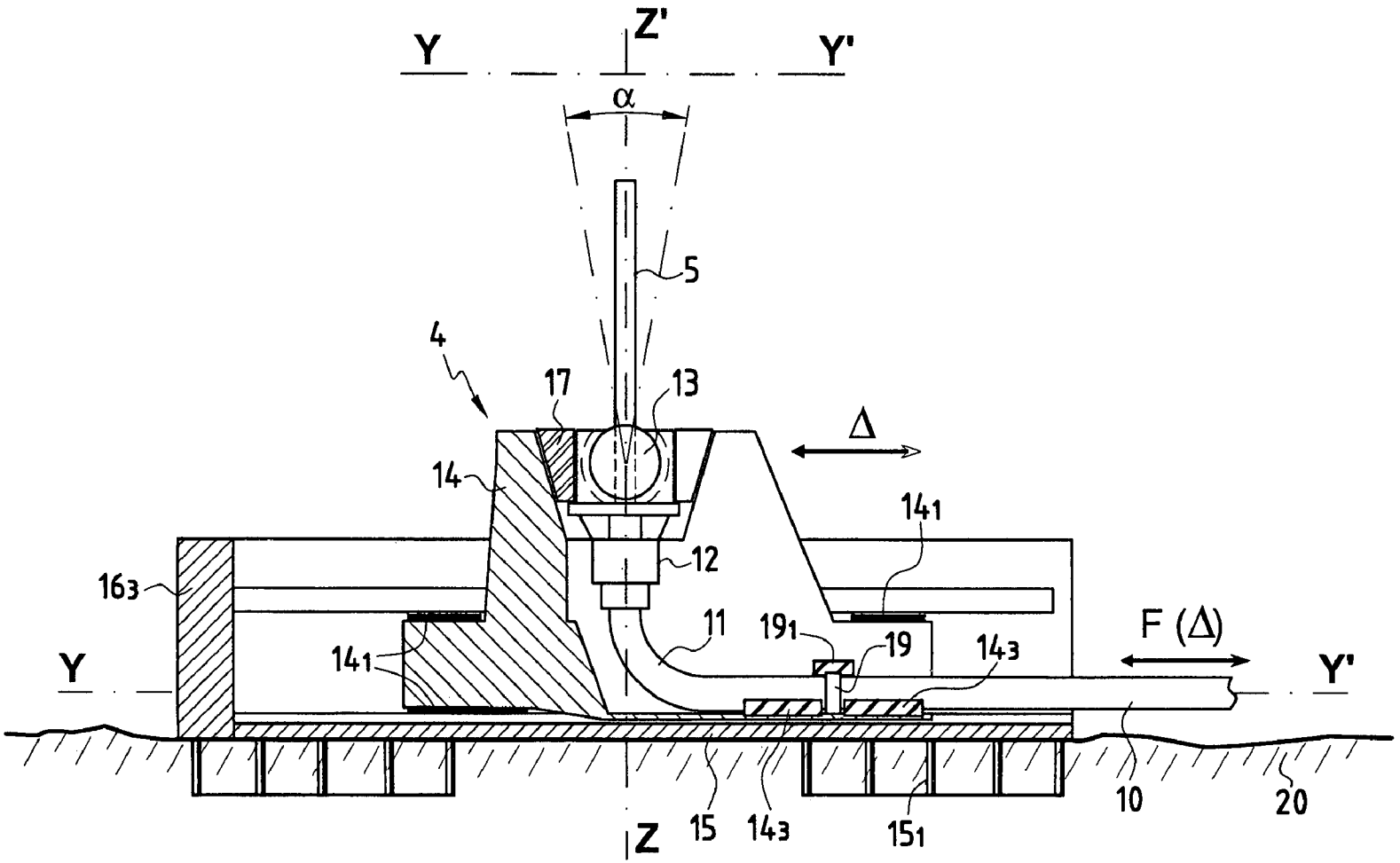
FIG. 4 is a side view in section of the bottom portion of the installation, after coupling.
Figure 10:
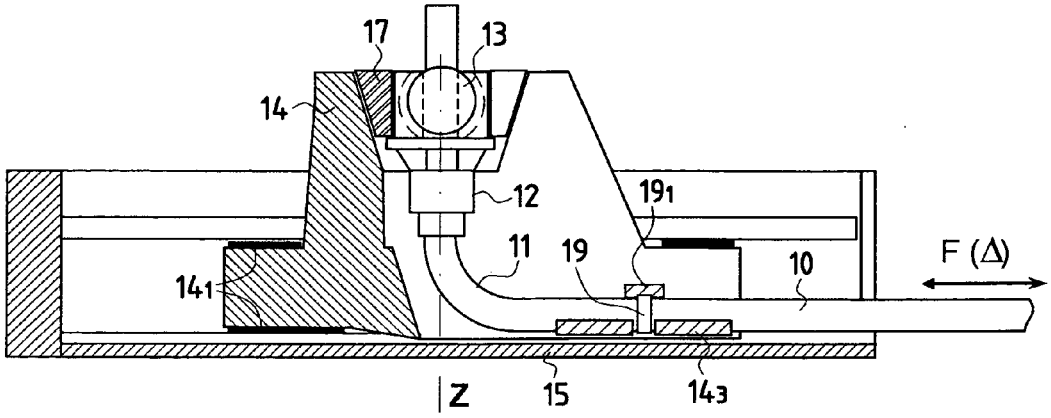
FIG. 10 is a side view in section of FIG. 9.

FIGS. 4 and 10 are side views of an installation of the invention, after the junction elements and the pipes for coupling together have been put into place.

Figure 11:
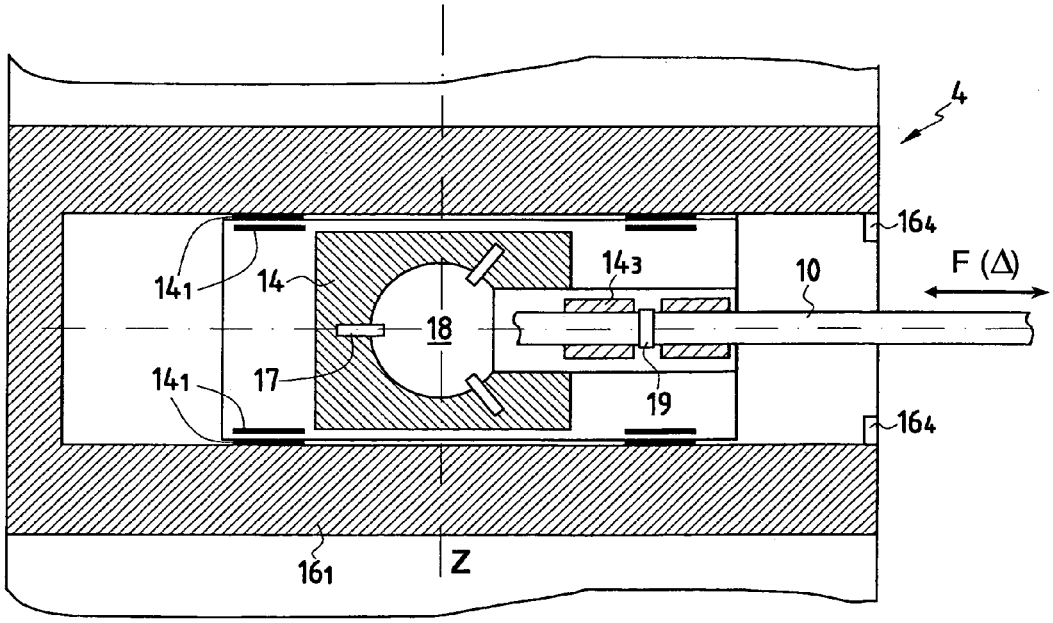
FIG. 11 is a plan view of a base of the invention including a moving support capable of sliding in translation on the platform 15 supporting guide barriers $\mathbf{16}_1$, said sliding in translation being controlled by an end abutment $\mathbf{16}_3$.
Figure 12:
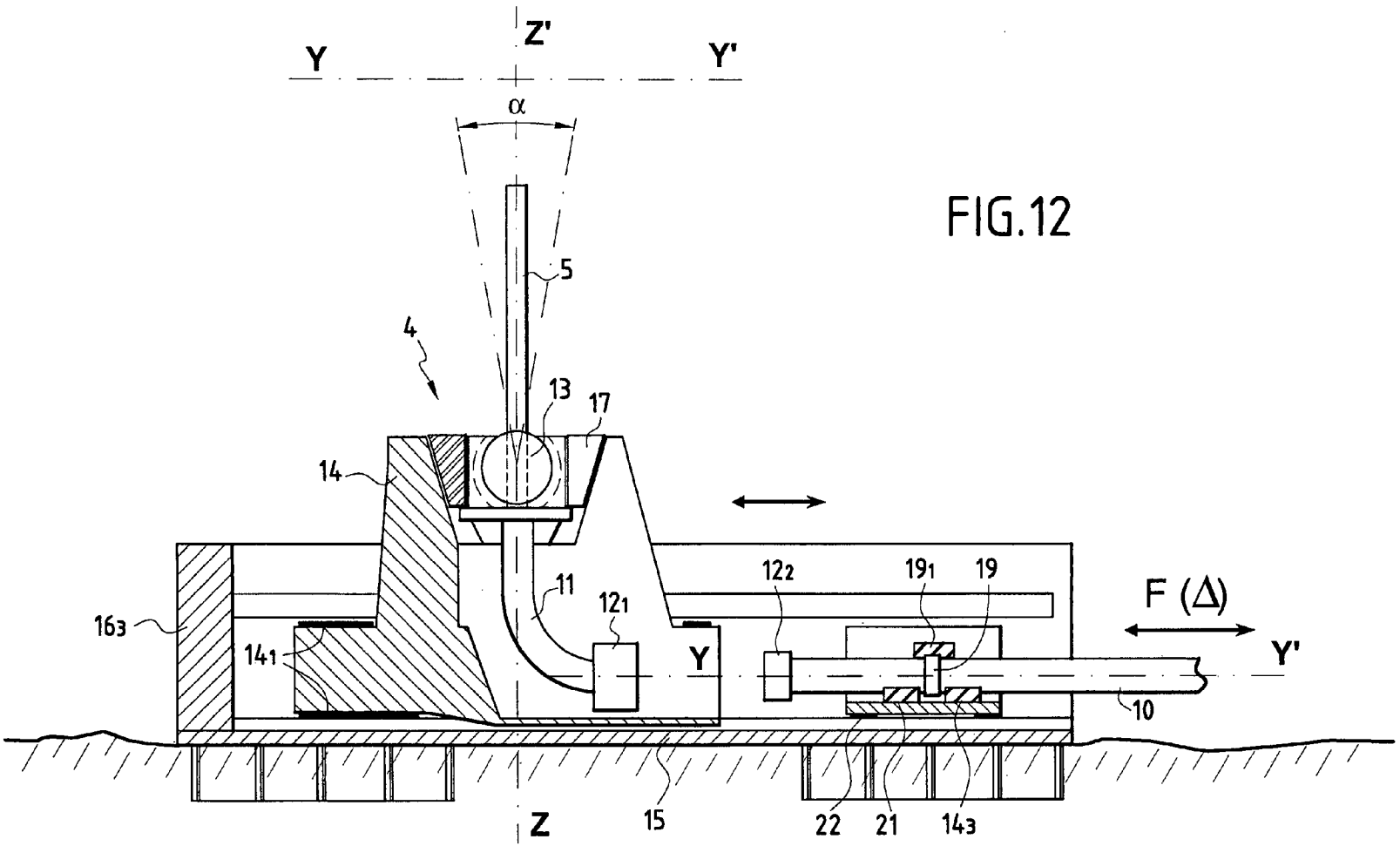
FIG. 12 is a side view in section of a variant embodiment of the pipe coupling in the installation of the invention.

In contrast, FIGS. 5 to 8 and also FIGS. 11 and 12 are views of the various component elements of the installation of the invention during the various stages of the procedure for putting elements into place.

Figure 5:
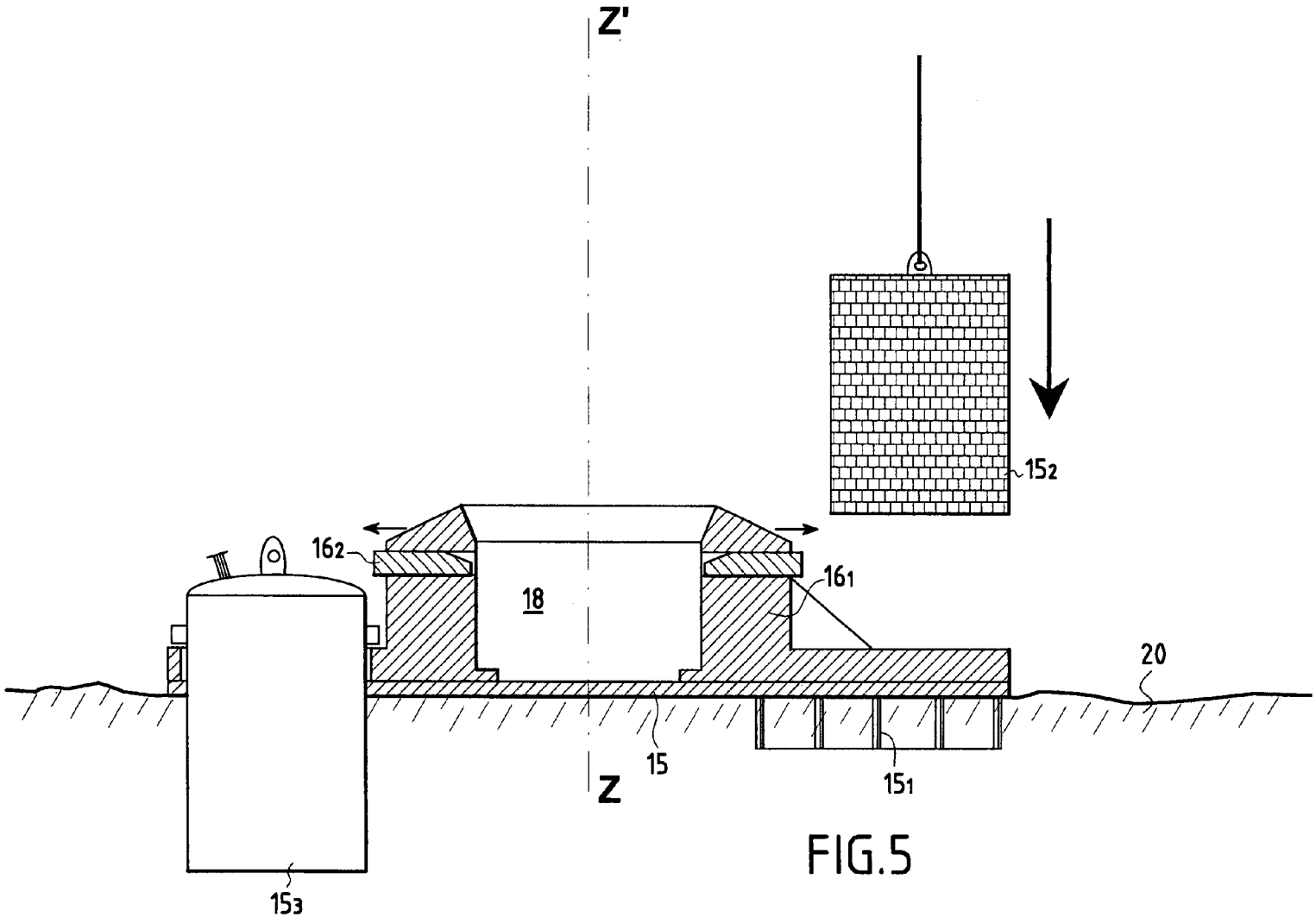
FIG. 5 is a side view of the base prior to installing of said moving support and said pipes to be coupled.

Thus, in FIG. 5, there can be seen the platform 15 surmounted by its lateral guide barriers $\mathbf{16}_1$ for providing guidance in sliding in longitudinal translation along the direction YY' for the moving support element whose bottom portion is held between said guide barriers $\mathbf{16}_1$.

FIGS. 10 and 11 show an abutment element $\mathbf{16}_3$ for controlling sliding in translation and preventing the moving support 14 from sliding too far inside the guide barriers $\mathbf{16}_1$ over the platform 15. This sliding in translation in the direction YY' is made possible with the help of sliding skids $\mathbf{14}_1$ placed beneath said moving support 14, on its sides, and on its top. It is also possible to use rollers or any other device seeking to reduce friction during longitudinal displacements in the direction YY'.

Figure 6:
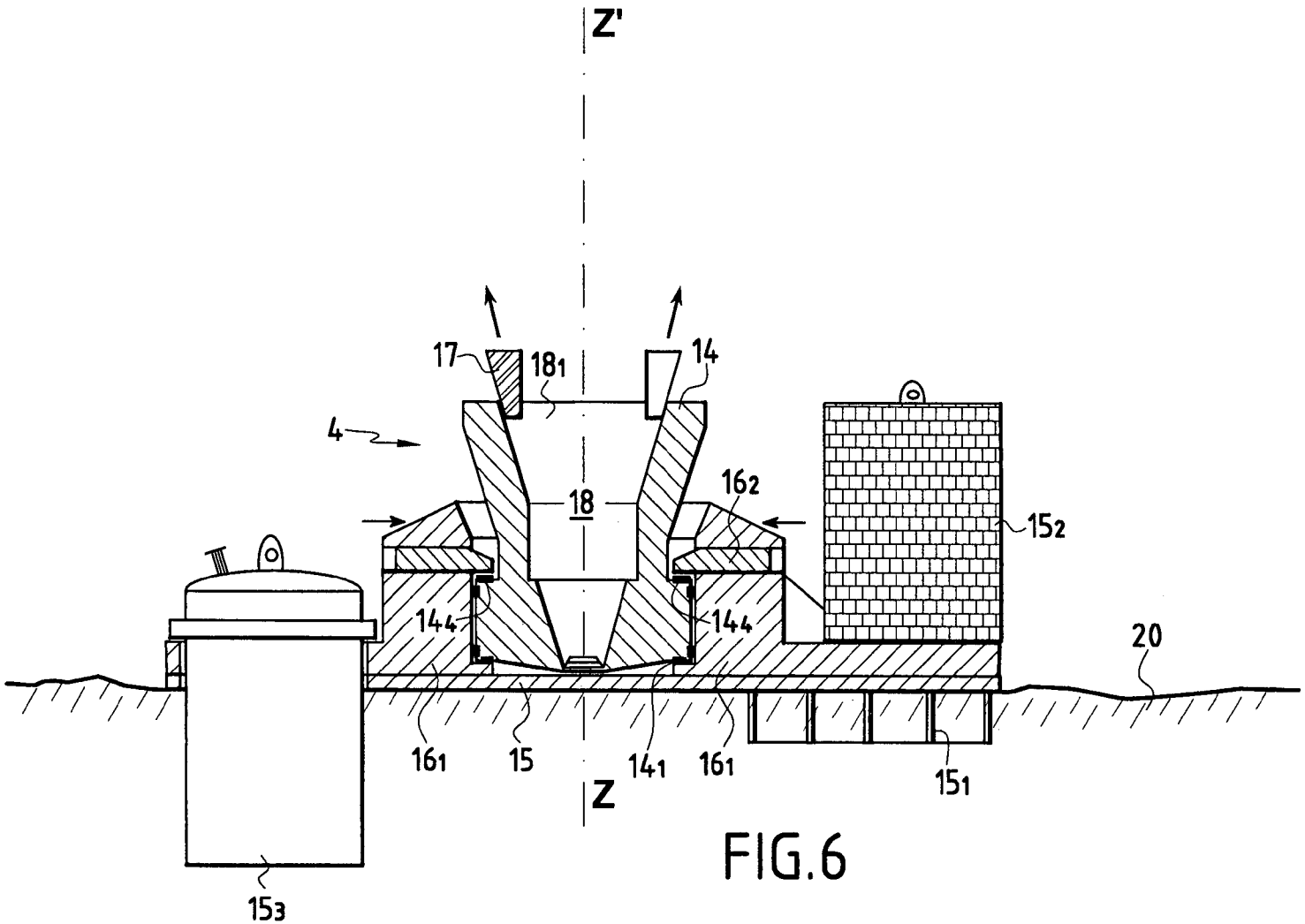
FIG. 6 is a side view of the base showing the platform and the moving support put into place prior to the pipe for coupling being put into place.

In FIG. 6, there can be seen the moving support 14 lowered from the surface by means of cables (not shown) and inserted between the upright structures constituting the guide barriers $\mathbf{16}_1$ disposed on the top of the guide platform 15. The moving support 14 can move along a longitudinal axis YY' because of the sliding skids $\mathbf{14}_1$, but it cannot move laterally along the axis XX', nor upwards along the axis ZZ'. The top portions of the guide barriers $\mathbf{16}_1$ co-operate with moving blocking elements constituting a wedge system $\mathbf{16}_2$, which elements can be engaged in such a manner as to come into abutment against the outside shape of the bottom portion of the moving support via a shoulder $\mathbf{14}_4$ carrying sliding skids $\mathbf{14}_1$, these skids coming into abutment against said wedges $\mathbf{16}_2$ once they have been engaged, thereby preventing the moving support 14 from being raised.

In FIGS. 2, 10, and 11, it can be seen that the guide barriers 16, placed on top of the platform 15 are spaced apart so as leave sufficient clearance, e.g. 1 cm, on either side of the moving support when it is in place on the platform between said guide barriers $\mathbf{16}_1$ so as to avoid possible jamming during displacement along the axis YY' of the moving support 14 over the platform 15.

The platform 15 is held in position on the sea bed 20 either by means of its own weight, or else by means of deadweight blocks $\mathbf{15}_2$, or by means of suction anchors $\mathbf{15}_3$ engaged through the platform, or indeed by a combination of these methods. Spades $\mathbf{15}_1$ are advantageously provided on the under-surface of the platform 15 to prevent any sliding or horizontal displacement of the platform in any direction.

In FIGS. 2, 6, 7, 8, and 12, there can be seen the moving support resting via its bottom skids $\mathbf{14}_1$ on the platform 15. More precisely, the bottom skids $\mathbf{14}_1$ rest on steps at the bottoms of the guide barriers $\mathbf{16}_1$. This type of positioning occurs when the top float 6 as shown in FIG. 1 is not fully deballasted and maintains the riser 5 under tension, with the weight of the moving support 14 being such that the moving support nevertheless rests on its bottom skids $\mathbf{14}_1$.

In contrast, in FIG. 9, when the top float 6 has been fully deballasted, the moving support 14 is suspended but cannot move upwards because of its top skids $\mathbf{14}_1$ coming into contact with the blocking elements $\mathbf{16}_2$ which co-operate with the top portions of the guide barriers $\mathbf{16}_1$ in such a manner as to retain the moving support 14 because of the outside shape of its bottom portion, and in particular because of its shoulder $\mathbf{14}_4$ which comes into contact via the top skids $\mathbf{14}_1$ with the blocking wedges $\mathbf{16}_2$.

By adjusting the buoyancy of the top float 6, it is possible to balance loads in such a manner as to reduce positive or negative contact forces, i.e. forces directed upwards or downwards, between the moving support 14 and the anchored structure comprising the platform 15 and the guide barriers $\mathbf{16}_1$. This has the effect of reducing wear on the skids $\mathbf{14}_1$, and above all of minimizing the forces F transmitted by the undersea pipe 10 to the anchored base of the riser tower, and also the compression pressures internal to said undersea pipe 10 which would otherwise constitute a potential source of buckling phenomena which can lead to the installation being destroyed.

By way of example, the platform 15 may be 10 m to 12 m long and 6 m wide, being capable of receiving dead-weights $\mathbf{15}_2$ of 25 tones to 50 tones. The mass of the moving support 14 may be 40 tones, corresponding to the minimum tension required at the bottom of the riser, i.e. at the flexible joint 13. Said moving support 14 may be about 1.5 m wide and 4 m long. During the installation process, the moving support 14 is positioned substantially in the middle of the platform, thus making it possible for relative displacement Δ of plus or minus 3 m along the axis XX', which displacement is generated by the thermal expansion or retraction, as well as of the undersea pipe 10, as well as by the inside pressure of the undersea pipe 10 resting on the sea bed.

In FIGS. 4 and 6 to 12 there can be seen a moving support 14 having a central cavity 18 whose top portion has a peripheral inside wall that flares in a funnel shape, said cavity 18 being upwardly open by means of an orifice $\mathbf{18}_1$ corresponding to said large base of the funnel-shaped top portion of the cavity 18. At the bottom of the cavity 18, a cradle $\mathbf{14}_3$ serves to receive and support the rigid pipe element 11 that presents an angled bend which is placed inside said moving support 14, as shown in FIGS. 2 and 9.

In a variant embodiment, the moving support presents an internal cavity that is also open at its bottom, thus making it possible to put the undersea pipe into place by installing it temporarily on the platform 15, after which the moving support is lowered onto the undersea pipe insofar as the central cavity of the moving support allows the angled element 11 to pass through together with the automatic connector 12, and finally, the undersea pipe is secured to the moving support whose cradle $\mathbf{14}_3$ and said locking means $\mathbf{19}$–$\mathbf{19}_1$ are situated on the wall of the inside cavity of the moving support situated above said pipe as initially installed on the platform 15.

In FIGS. 4, 10, and 11, the undersea pipe 10 resting on the sea bed is terminated by a rigid pipe element 11 presenting an angled bend, terminating at its upwardly facing top end in a first portion $\mathbf{12}_1$ of a coupling element 12, specifically in this case a male portion. The horizontal rectilinear end portion of the undersea pipe 10 resting on the sea bed situated in front of said angled pipe element 11 is supported by the cradle $\mathbf{14}_3$ on the bottom of said moving support 14, and it is locked by a device 19 serving to lock a collar $\mathbf{19}_1$, itself welded onto the outside of the undersea pipe 10. During displacement of the moving support 14 caused by expansion of the undersea pipe 10 resting on the sea bed, due to the effects of temperature and internal pressure, said moving support 14 slides within the anchored platform $\mathbf{15}$–$\mathbf{16}_1$–$\mathbf{16}_2$ between the lateral guide barriers $\mathbf{16}_1$. This greatly reduces the forces that are transmitted to said angled base, and also the compression forces within the undersea pipe resting on the sea bed, thereby eliminating any risk of buckling and of damage to said undersea pipe 10.

Figure 7:
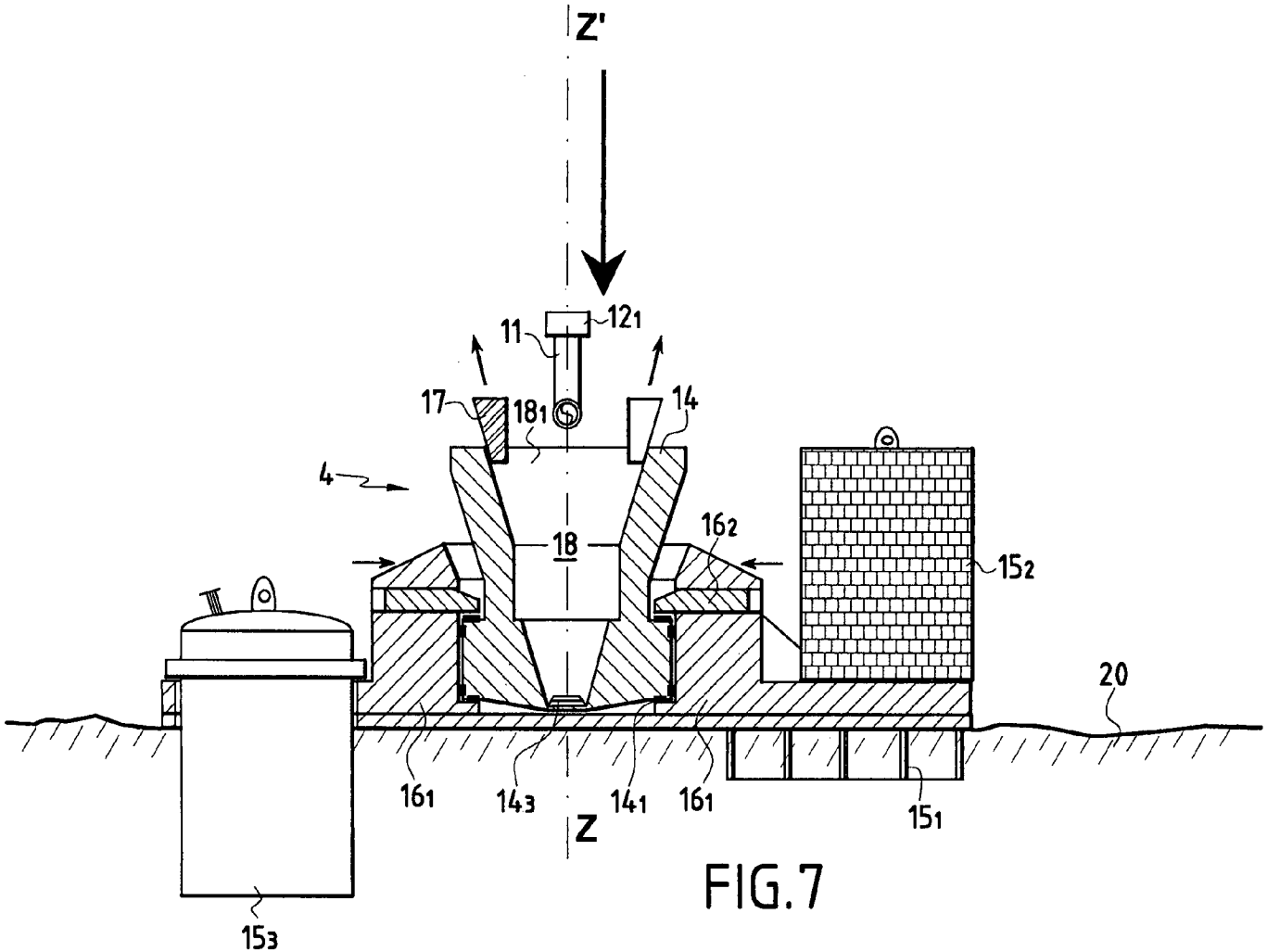
FIG. 7 is a section view of the bottom portion of the installation showing the pipe element having an angle bend being put into place by being lowered into said moving support.
Figure 8:
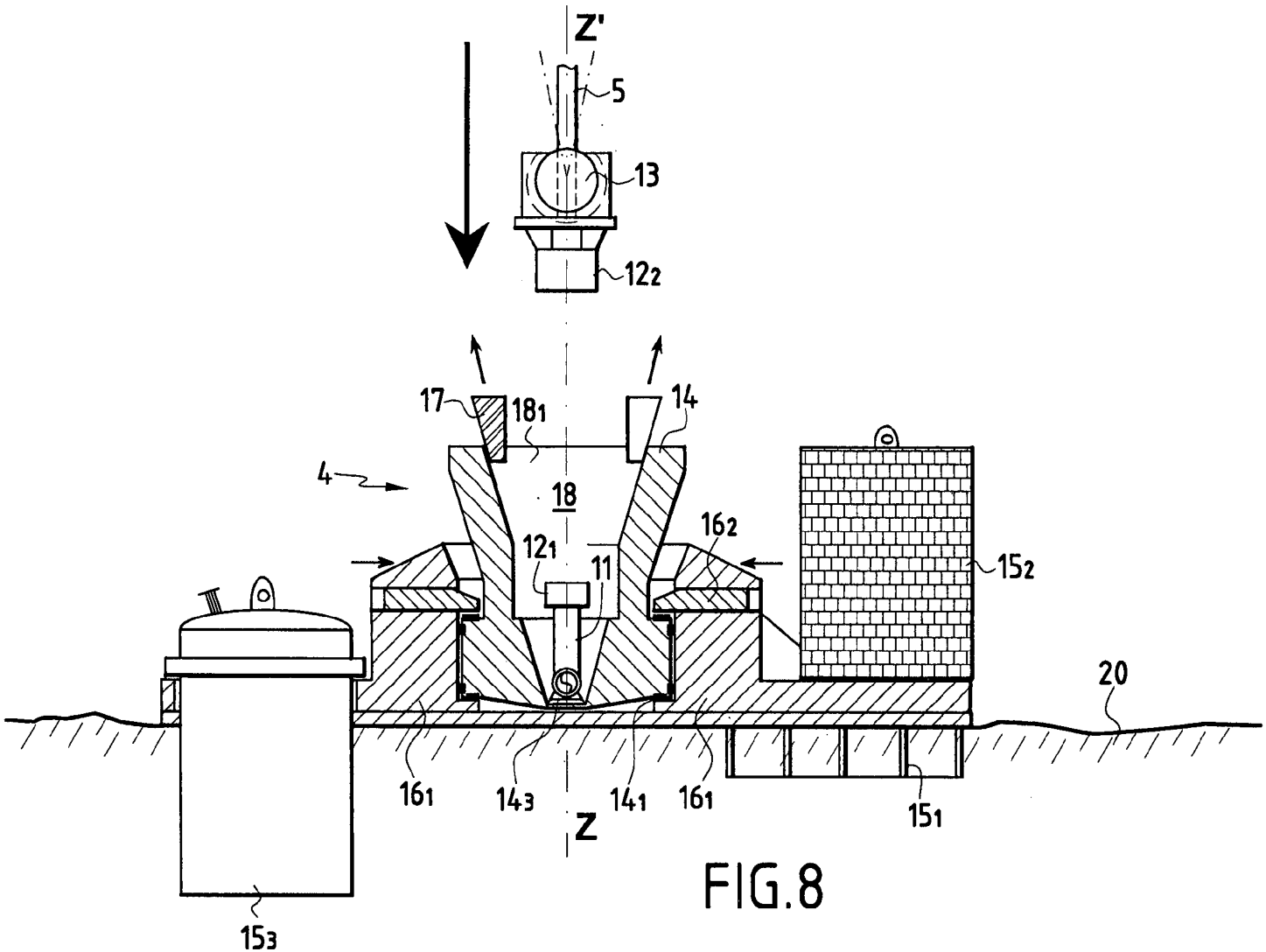
FIG. 8 is a section view of the bottom portion of the installation during the step following the step of FIG. 7 in which, once the pipe element having an angled bend has been put into place, the bottom end of said riser is lowered into said moving support, said bottom end being fitted with a flexible joint and with a female portion of a coupling element.

In the embodiment of FIGS. 2 to 11, and in particular as shown in FIG. 8, the bottom end of the vertical riser has a flexible joint 13, itself secured to the underface of the second portion $\mathbf{12}_2$ of the automatic connector 12 for co-operating with the first portion $\mathbf{12}_1$ to couple the coupling element 12 constituting an automatic connector. The internal passage through the flexible joint 13 and the automatic connector 12 has an inside diameter that is preferably identical to that of the riser 5. The flexible joint 13 is reinforced by an external reinforcing structure which enables it to be received in the top orifice $\mathbf{18}_1$ of the cavity 18 in the moving support 14 so as to ensure that the assembly is rigid when a system of truncated-cone wedges 17 comes to lock the moving support 14 definitively in the cavity 18 via its top orifice $\mathbf{18}_1$, as shown in the figures. The leaktight flexible joint may be of the mechanical ball type or of the flexible elastomer joint type, or it may correspond to a limited length of flexible hose capable of allowing the vertical riser 5 the same amount of angular displacement, in particular within a cone of angle α that may be as great as 15°.

The pipe element 11 presenting an angled bend has a bend comprising a circular arc with a large radius of curvature, in particular a radius of curvature greater than 5 m, and more particularly lying in the range 5 m to 10 m, and it is implemented by a curved pipe element that is 7 m to 15 m long.

In the method of the invention for putting an installation into place, the following steps can be performed in succession:

1. said platform 15 surmounted by the guide support constituted by the barriers $\mathbf{16}_1$ co-operating with the blocking elements or wedge system $\mathbf{16}_2$ in their top portions is put into place on the sea bed; and
2. the platform 15 is anchored with the help of various anchor means such as deadweights $\mathbf{15}_2$ which are lowered by means of cables or suction anchors $\mathbf{15}_3$; and
3. a said moving support 14 is lowered and inserted between the guide barriers $\mathbf{16}_1$ from above the platform 15, and the locking latches $\mathbf{16}_2$ are actuated to prevent the moving support 14 moving upwards in the direction ZZ' while leaving it free to slide in translation in the longitudinal direction YY' of the moving support 14, said sliding in translation along the direction YY' being controlled by the abutment elements $\mathbf{16}_3$–$\mathbf{16}_4$ resting on the platform 15; and
4. a rectilinear pipe element is installed in the bottom of the cavity 18 of said moving support by being lowered through the top orifice $\mathbf{18}_1$, said rectilinear pipe element constituting the horizontal end portion of the undersea pipe 10 resting on the sea bed, said horizontal end portion being fitted at its end with a said rigid pipe element 11 presenting an angled bend, which angled element 11 has a first male portion $\mathbf{12}_1$ of an automatic connector 12 at its top end; and
5. said rigid angled pipe element 11 is placed in the bottom of the cavity 18 in such a manner that the rectilinear horizontal end portion of the undersea pipe resting on the sea bed rests on the cradle $\mathbf{14}_3$, and said horizontal end portion of the undersea pipe 10 resting on the sea bed is secured using a collar type locking system 19, $\mathbf{19}_1$; and 6. a vertical riser 5 fitted at its bottom end with a reinforced flexible joint 13 and with the complementary female second portion $\mathbf{12}_2$ of said automatic connector 12 located on the underface of said reinforced flexible joint 13 is lowered; and then
7. after said first and second complementary portions $\mathbf{12}_1$ and $\mathbf{12}_2$ of said coupling element 12 have been brought together, said coupling is performed; and
8. once coupling has been achieved, said reinforced flexible joint or an end pipe portion at the bottom end of said riser beneath said reinforced flexible joint 13 is blocked inside the top orifice $\mathbf{18}_1$ comprising a peripheral wall of flared shape by means of a wedge system that becomes blocked between said funnel-shaped peripheral wall of said top opening $\mathbf{18}_1$ and said reinforced flexible joint 13 or said end pipe portion beneath said flexible joint 13.

Wedges 17 shown in FIGS. 6 to 8 in the disengaged position relative to said wall of the top orifice $\mathbf{18}_1$ are actuated by an ROV using hydraulic actuators (not shown) so as to subsequently become engaged inside the top orifice $\mathbf{18}_1$ against its flared peripheral wall, as shown in FIGS. 4, 9, 10, and 12. The truncated cone-shaped wedges 17 come into abutment and bear against the reinforcing structure of said reinforced flexible joint 13, thereby holding it in a position that is fixed relative to the moving support 14.

Additional latches $\mathbf{14}_2$ are then actuated by a device (not shown) thus enabling the entire vertical load created by the riser 5 kept under tension by the top float 6 (FIG. 1) to be transferred to the moving support $\mathbf{14}_4$.

Figure 3:
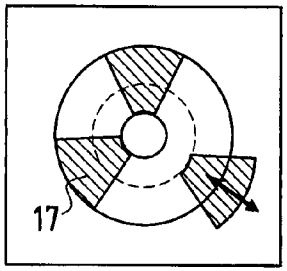
FIG. 3 is a plan view showing the top orifice of the moving support 14 of FIG. 2 with a system of truncated-cone wedges 17.

FIG. 3 is a plan view in section showing the top orifice $\mathbf{18}_1$ together with three truncated cone wedges 17, one of which is shown in an upwardly-retracted position, while the other two are shown in the wedging position being engaged downwards into the orifice $\mathbf{18}_1$.

The installation of the invention as described above with reference to FIGS. 2 to 11 has a reinforced flexible joint 13 situated above a portion $\mathbf{12}_2$ of an automatic connector 12.

In another embodiment as shown in FIG. 12, said rigid pipe element 11 presenting an angled bend is pre-installed at the underface of said reinforced flexible joint 13, said angled pipe element 11 presenting at its free bottom end a first portion $\mathbf{12}_2$ of a coupling element 12 of the automatic connector type.

In this case, said first portion $\mathbf{12}_2$ of the coupling element has its axis disposed horizontally slightly above the bottom of the cavity 18 of the moving support 14 once the flexible joint 13 is blocked in position in the top opening $\mathbf{18}_1$ of the moving support 14 by means of the wedges 17. Thereafter, coupling is implemented with the undersea pipe 10 resting on the sea bed, which pipe has its horizontal rectilinear end portion resting on a carriage 21 sliding on the platform 15 by means of sliding skids 22, said rectilinear horizontal end portion of the undersea pipe 10 resting on the sea bed being held by cradles $\mathbf{14}_3$ on the bottom of said moving carriage 21, and being secured to said carriage 21 by a locking collar 19–$\mathbf{19}_1$. Coupling is performed by moving said moving carriage 21 in said longitudinal direction YY' between said sliding barriers $\mathbf{16}_1$ on the platform 15. Finally, the carriage 21 is secured to the moving support 14 by means that are not shown.

Because of its complexity, it is preferable to install the female portion $\mathbf{12}_2$ of an automatic connector 12 on the piece of equipment that is the last piece to be handled, but said male and female first and second portions $\mathbf{12}_1$ and $\mathbf{12}_2$ of the coupling element could be interchanged.

In FIG. 1, the installation has a connection device $\mathbf{4}_1$, 7 between said float 6 and the top end of said riser 5, the connection device comprising:

a second flexible hose 7 whose ends are engaged respectively in the underface of said float 6 and the top end of the riser 5;

said second flexible hose 7 being connected to the top end of said riser 5 via a swan-neck-shaped device $\mathbf{4}_1$, which swan-neck-shaped device $\mathbf{4}_1$ also provides a connection between said riser 5 and a said flexible hose 3 connected to the floating support; and said second flexible hose 7 being extended through said float 6 by a rigid tubular pipe 8 passing right through the float so as to make it possible to take action on the inside of said vertical riser 5 from the top end of the float 6 via said rigid tubular pipe 8, then via said connection device constituted by said second flexible hose 7, and via said swan-neck-shaped device $\mathbf{4}_1$ so as to gain access to the inside of said riser 5 and clean it by injecting liquid and/or by scraping the inside wall of said riser 5, and then the inside wall of said undersea pipe 10 resting on the sea bed.

At its ends, said second flexible hose 7 presents elements $\mathbf{7}_1$, $\mathbf{7}_2$ of progressively varying second moment of area in the vicinity respectively of the underface of the float 6 and the top end of the swan neck.

The swan-neck-shaped device comprises a top rectilinear portion providing the junction between said vertical riser and said second flexible hose connected to said float. A curved branch forming a bend extending from said rectilinear portion of the swan-neck-shaped device serves to provide the junction between the end of said vertical riser and the end of said first flexible hose itself connected to said floating support. The ends of said curve are substantially tangential to the catenary curve taken up by said first flexible hose that provides the connection with the floating support, and subsequently tangential with said rectilinear portion of the swan-neck-shaped device.

What is claimed is:

1. A bottom-to-surface connection installation for an undersea pipe resting on the sea bed, in particular at great depth, the installation comprising:

a) at least one vertical riser having its bottom end connected to at least one undersea pipe resting on the sea bed, and having at least one float at its top end;

b) at least one connection pipe, preferably a flexible hose, providing the connection between a floating support and the top end of said vertical riser; and c) the connection between the bottom end of said vertical riser and a said undersea pipe resting on the sea bed is made via an anchor system comprising a base placed on the sea bed, the installation being characterized in that:

said base serves to hold and guide junction elements between the bottom end of said vertical riser and the end of the rectilinear horizontal end portion of said pipe resting on the sea bed;

said junction elements comprise a rigid pipe element presenting an angled bend and a pipe coupling element, preferably a single coupling element, and more preferably a single automatic connector and they are fixed to a moving support of said base suitable for moving, preferably in controlled manner, on a platform of said base resting on the sea bed;

said junction elements are held and guided in such a manner that said junction elements fixed to said moving support are free to move only in translation in a single longitudinal direction YY' corresponding substantially to the axial direction of said horizontal rectilinear end portion of said undersea pipe resting on the sea bed.

2. An installation according to claim 1, characterized in that the bottom end portion of said vertical riser has a preferably reinforced flexible joint enabling the portion of said vertical riser situated above said flexible joint to move angularly ($\alpha$), and said junction elements comprise said flexible joint or a portion of said vertical riser situated beneath said flexible joint.

3. An installation according to claim 1, characterized in that:

a preferably male first portion of said coupling element is secured to said flexible joint and located immediately beneath it; and said undersea pipe resting on the sea bed is terminated by a said rigid pipe element having an angled bend presenting at its end a preferably female second portion of a said coupling element suitable for co-operating with said first portion to form said coupling element.

4. An installation according to claim 1, characterized in that:

said rigid pipe element presenting an angled bend is fixed directly to the underface of said flexible joint and at its other end has a preferably female first portion of a said coupling element; and said preferably female first portion of the coupling element co-operates with a preferably male second portion of the coupling element at the end of a horizontal end portion of an undersea pipe on the sea bed so as to form a said coupling element.

5. An installation according to claim 1, characterized in that said moving support includes a central cavity that is upwardly-open via a top orifice suitable for receiving said rigid pipe element presenting an angled bend within said moving support when said element is lowered from the surface.

6. An installation according to claim 5, characterized in that said top orifice co-operates with blocking elements, preferably a wedge system, enabling said reinforced flexible joint to be blocked, which joint is thus held rigidly and securely to said moving support, and the horizontal end portion of said pipe resting on the sea bed is held securely to the bottom of said moving support, preferably by means of a collar system.

7. An installation according to claim 6, characterized in that said top orifice presents a funnel-shaped peripheral inside wall with a large base on top, and said wedges enabling said reinforced flexible joint to be blocked are constituted by truncated-cone wedges.

8. An installation according to claim 1, characterized in that said platform includes guide and holding elements for engaging said moving support in such a manner that said moving support can move on said platform only by sliding in translation in said longitudinal direction YY', preferably with the help of sliding skids.

9. An installation according to claim 8, characterized in that said moving support is held laterally between two lateral guide barriers of said platform, and said lateral guide barriers co-operate with moving blocking elements which, in a disengaged, retracted position allow said moving support to be lowered from the surface into a position between said two lateral barriers from above said platform, and in an advanced, blocking position co-operate with the outside shape of said moving support so as to control vertical upward displacement ZZ' thereof.

10. An installation according to claim 1, characterized in that said base comprises a platform resting on the sea bed, which platform co-operates with stabilizing elements comprising deadweights placed on top of said platform, or suction anchors passing through said platform in order to be engaged in the sea bed, and/or spade-type projecting elements placed on the underface of said platform and engaged in the sea bed to prevent any sliding of said platform over the sea bed.

11. A method of putting an installation according to claim 1 into place, the method being characterized in that it comprises the following steps:

(a) placing a said base on the sea bed;

(b) lowering to the sea bed, a said undersea pipe for resting on the sea bed, the pipe having at its end at least a portion of said junction elements including at their end a first portion of a coupling element;

(c) securing the rectilinear horizontal end portion of said pipe resting on the sea bed to said base;

(d) lowering said vertical riser including at its end at least the other portion of said junction elements, comprising at their bottom end at least a said second portion of a coupling element;

(e) coupling said first and second portions together to form said coupling element; and (f) blocking said junction elements on said base.

12. A method according to claim 11, in which said base comprises a said platform and at least a said moving support, and in which the following steps are performed:

(g) placing said platform on the sea bed, and placing said moving support on said platform, then actuating said latches to control and prevent upward displacement of said moving support relative to said platform while leaving said moving support free to move in controlled translation in said longitudinal direction YY';

(h) lowering a said undersea pipe to the sea bed and putting it in place thereon, the pipe being fitted at its end with at least a portion of said junction elements including at their end at least a said first portion of a coupling element;

(i) securing the horizontal rectilinear end portion of said pipe resting on the sea bed on the bottom of said moving support;

(j) lowering a said vertical riser fitted at its bottom end with at least the other portion of said junction elements comprising at their end a said complementary second portion of a coupling element;

(k) moving said first and second portions of a coupling element towards each other and coupling them together; and (l) blocking said junction elements on said moving support.

13. A method according to claim 12, characterized in that:

a) said undersea pipe resting on the sea bed is fitted at its end with a said rigid pipe element presenting an angled bend, said angled pipe element presenting at its top end a said first portion of a coupling element; and b) said vertical riser is fitted at its bottom end with a said flexible joint and with a said second portion of a coupling element at the underface of said flexible joint.

* * * * *